US012258201B2

(12) United States Patent
Bodet et al.

(10) Patent No.: US 12,258,201 B2
(45) Date of Patent: Mar. 25, 2025

(54) VALVE CUP FOR PRESSURIZED CONTAINER

(71) Applicant: LINDAL FRANCE SAS, Val de Briey (FR)

(72) Inventors: Hervé Bodet, Verdun (FR); Eric Gaillard, Dieue-sur-Meuse (FR)

(73) Assignee: LINDAL FRANCE SAS, Val de Briey (FR)

( * ) Notice: Subject to any disclaimer, the term of this patent is extended or adjusted under 35 U.S.C. 154(b) by 0 days.

(21) Appl. No.: 17/629,142

(22) PCT Filed: Jul. 13, 2020

(86) PCT No.: PCT/EP2020/069732

§ 371 (c)(1),
(2) Date: Jan. 21, 2022

(87) PCT Pub. No.: WO2021/013605

PCT Pub. Date: Jan. 28, 2021

(65) Prior Publication Data

US 2022/0289468 A1 Sep. 15, 2022

(30) Foreign Application Priority Data

Jul. 24, 2019 (FR) ..... 1908421
Nov. 25, 2019 (BE) ..... 2019/5836

(51) Int. Cl.
*B65D 83/38* (2006.01)
*B65D 83/48* (2006.01)
*B65D 83/62* (2006.01)

(52) U.S. Cl.
CPC ..... *B65D 83/38* (2013.01); *B65D 83/48* (2013.01); *B65D 83/62* (2013.01)

(58) Field of Classification Search
CPC ..... B65D 83/38; B65D 83/48; B65D 83/62
See application file for complete search history.

(56) References Cited

U.S. PATENT DOCUMENTS 2,709,111 A * 5/1955 Green ..... B65D 83/46 239/577
2,731,298 A * 1/1956 Green ..... B65D 83/46 141/20

(Continued)

FOREIGN PATENT DOCUMENTS

AR 029850 A1 7/2003
CA 1337812 C 12/1995

(Continued)

OTHER PUBLICATIONS

Fix Definition & Meaning—Merriam-Webster.pdf; obtained on Oct. 17, 2023 from: https://www.merriam-webster.com/dictionary/fix.*

(Continued)

*Primary Examiner* — Paul R Durand
*Assistant Examiner* — Randall A Gruby
(74) *Attorney, Agent, or Firm* — Seckel IP, PLLC

(57) ABSTRACT

The valve cup for pressurized container has an outer face and an inner face and is provided with a peripheral bearing edge (51) for placing the cup on a can, a central opening for the passage of a product outlet rod (31), a descending wall in the continuation of the bearing edge, and a bottom wall between the descending wall and the central opening, which bottom wall comprises at least one frustoconical peripheral portion the outer face of which is concave.

20 Claims, 5 Drawing Sheets

(56) References Cited

U.S. PATENT DOCUMENTS 2,775,483 A * 12/1956 Treharne, Jr. ..... B65D 83/425 251/210
2,854,176 A 9/1958 Edwards
2,965,271 A * 12/1960 Soffer ..... B65D 83/46 222/542
3,169,677 A * 2/1965 Focht ..... B65D 83/54 239/350
3,180,535 A * 4/1965 Ward ..... B65D 83/525 222/335
3,424,353 A * 1/1969 Meador ..... B65D 83/44 222/402.1
3,512,685 A 5/1970 Ewald
3,593,886 A * 7/1971 Morane ..... B65D 83/682 222/402.18
3,593,887 A * 7/1971 Morane ..... B65D 83/682 222/402.17
3,598,292 A 8/1971 Kiliany
3,627,179 A * 12/1971 Scheindel ..... B65D 83/48 222/518
3,674,180 A * 7/1972 Morane ..... B65D 83/682 222/402.18
3,702,669 A 11/1972 Ewald
3,738,542 A * 6/1973 Ruscitti ..... B65D 83/54 222/402.2
3,741,446 A 6/1973 Marand
3,819,090 A 6/1974 Birrell
3,830,412 A 8/1974 Green
3,893,653 A * 7/1975 Kolanus ..... B65D 83/48 251/353
3,915,390 A * 10/1975 Green ..... B65D 83/48 222/394
3,958,727 A 5/1976 Steiman
3,982,668 A * 9/1976 Riccio ..... B65D 83/682 222/402.18
4,441,635 A * 4/1984 Beard ..... F16K 31/58 222/402.21
4,463,784 A 8/1984 Butcher et al.
4,792,067 A 12/1988 Greenebaum, II
4,813,576 A 3/1989 Greenebaum, II
4,919,312 A * 4/1990 Beard ..... G01F 11/28 222/402.2
4,958,757 A * 9/1990 Greenebaume, II ... B65D 83/38 222/402.1
5,016,785 A * 5/1991 Greenebaum ..... B65D 83/38 222/402.1
5,082,652 A 1/1992 Mayfield et al.
5,215,209 A * 6/1993 Radtke ..... B65D 83/38 222/402.1
5,406,689 A 4/1995 Radtke
5,769,283 A 6/1998 Owada et al.
5,881,929 A 3/1999 Coerver, Jr.
5,906,046 A * 5/1999 Abplanalp ..... B65D 83/46 29/890.127
5,915,598 A 6/1999 Yazawa et al.
5,957,342 A 9/1999 Gallien
6,070,770 A 6/2000 Tada et al.
6,112,950 A 9/2000 Di Giovanni et al.
6,152,190 A * 11/2000 Smith ..... B65D 83/425 222/402.1
6,161,599 A * 12/2000 Smith ..... B65D 83/425 222/402.1
6,244,475 B1 * 6/2001 Walz ..... B65D 83/38 222/387
6,296,156 B1 10/2001 Lasserre et al.
6,357,633 B1 * 3/2002 Zimmerhackel ..... B65D 83/48 222/402.1
6,454,140 B1 9/2002 Jinks
6,527,149 B1 3/2003 Garcia et al.
6,824,079 B2 11/2004 Kendrick et al.
6,832,704 B2 12/2004 Smith
7,086,571 B2 8/2006 Warby et al.
7,124,788 B2 * 10/2006 Pericard ..... B65D 83/62 141/3
7,798,366 B2 * 9/2010 Hoshino ..... B65D 83/62 222/105
8,292,121 B2 * 10/2012 Davideit ..... B65D 83/425 222/105
8,678,248 B2 * 3/2014 Davideit ..... B65D 83/54 222/542
9,132,955 B2 9/2015 Smith et al.
9,192,948 B2 11/2015 Bodet et al.
9,254,954 B2 * 2/2016 Davideit ..... B65D 83/48
9,554,982 B2 1/2017 Swaile et al.
9,573,750 B2 2/2017 Seling et al.
9,624,021 B2 * 4/2017 Bodet ..... B05C 17/00559
9,694,967 B2 7/2017 Salameh
10,246,251 B2 4/2019 Bodet et al.
10,399,767 B2 * 9/2019 Plaschkes ..... B65D 83/48
10,532,881 B2 1/2020 Bodet et al.
10,562,697 B2 * 2/2020 Ramsey ..... B65D 83/38
10,661,291 B2 * 5/2020 Schmid ..... B65D 83/546
10,793,343 B1 * 10/2020 Alonso ..... B65D 83/48
11,273,972 B2 * 3/2022 Bodet ..... B65D 83/44
11,299,338 B2 4/2022 Jasper et al.
11,332,301 B2 * 5/2022 Borel ..... B65D 83/68
11,845,605 B2 * 12/2023 Jasper ..... B29C 66/5344
11,866,248 B2 * 1/2024 Baker ..... B65D 83/40
11,884,477 B2 1/2024 Jasper et al.
2002/0190085 A1 12/2002 Stanford
2003/0024953 A1 * 2/2003 Peter Lilienthal ... B65D 83/682 222/402.1
2003/0089739 A1 * 5/2003 O'Connor ..... B65D 83/682 222/402.1
2004/0226964 A1 * 11/2004 Bourque ..... B65D 83/62 222/136
2005/0121476 A1 * 6/2005 Pauls ..... B65D 83/48 222/402.24
2009/0001103 A1 1/2009 Wanbaugh
2009/0078903 A1 * 3/2009 Rideg ..... F16F 1/326 251/321
2010/0044400 A1 2/2010 Laidler
2010/0051651 A1 3/2010 Allsop
2010/0300916 A1 * 12/2010 Alvares ..... B65D 83/38 220/4.12
2011/0007987 A1 1/2011 Davideit et al.
2011/0127300 A1 * 6/2011 Ghavami-Nasr ..... B65D 83/14 222/402.1
2013/0092710 A1 * 4/2013 Bodet ..... B65D 83/52 222/402.2
2015/0034682 A1 2/2015 seling et al.
2015/0108387 A1 4/2015 Smith
2015/0197392 A1 7/2015 Franz et al.
2015/0329273 A1 11/2015 Salameh
2015/0375922 A1 12/2015 Smith et al.
2016/0009482 A1 * 1/2016 Martz ..... B65D 83/46 137/605
2016/0152404 A1 * 6/2016 Hawthorne ..... B65D 83/20 222/153.09
2017/0008692 A1 * 1/2017 Davideit ..... B65D 83/48
2018/0022536 A1 * 1/2018 Borel ..... B65D 83/42 141/3
2018/0127195 A1 5/2018 Ramsey
2018/0134481 A1 5/2018 Bodet et al.
2018/0222613 A1 8/2018 Geier et al.
2018/0222647 A1 8/2018 Geier et al.
2019/0161268 A1 5/2019 Geier
2020/0087053 A1 3/2020 Geier
2021/0002064 A1 * 1/2021 Tsubouchi ..... B65D 83/752
2021/0107727 A1 * 4/2021 Borel ..... B65D 83/44
2022/0274770 A1 * 9/2022 Bodet ..... B65D 83/38
2022/0289468 A1 * 9/2022 Bodet ..... B65D 83/38
2022/0297925 A1 * 9/2022 Bodet ..... B65D 83/48

FOREIGN PATENT DOCUMENTS

CH 676585 A5 2/1991
DE 3544924 A1 7/1987
EP 0108550 A2 5/1984
EP 0258299 A1 3/1988
EP 3526138 B1 4/2020
FR 2441778 A1 6/1980

(56) References Cited

FOREIGN PATENT DOCUMENTS

| | | | |
|---|---|---|---|
| FR | 2508136 | A1 | 12/1982 |
| FR | 2741048 | A1 | 5/1997 |
| FR | 2971773 | A1 | 8/2012 |
| FR | 3038589 | A1 | 1/2017 |
| GB | 2037378 | B | 10/1982 |
| JP | H11-171270 | A | 6/1999 |
| WO | 8101130 | A1 | 4/1981 |
| WO | 8908062 | A1 | 9/1989 |
| WO | 2007107174 | A1 | 9/2007 |
| WO | 2015158609 | A1 | 10/2015 |
| WO | 2016202754 | A1 | 12/2016 |
| WO | 2017021038 | A1 | 2/2017 |
| WO | 2017021039 | A1 | 2/2017 |
| WO | 2018052973 | A1 | 3/2018 |
| WO | 2018073042 | A1 | 4/2018 |
| WO | 2023131621 | A1 | 7/2023 |

OTHER PUBLICATIONS

International Search Report and Written Opinion dated Oct. 1, 2020 in application No. PCT/EP2020/069713 corresponding to co-pending U.S. Appl. No. 17/629,125; w/ English partial translation and partial machine translation (total 14 pages) (D1 and D3 cited in the ISR and refs. 1 and 2 cited in the Specification of the co-pending U.S. Appl. No. 17/629,125 are not listed in this IDS form since they are already listed in the other IDS form).

International Search Report and Written Opinion dated Oct. 21, 2020 in corresponding application No. PCT/EP2020/069732; w/ English partial translation and partial machine translation (total 15 pages).

European Search Report and Written Opinion dated Apr. 14, 2023 in application No. EP 23152857, divisional of counterpart application No. EP20743094; with English machine translation (total 17 pages) (Note: WO8908062, D6 and WO2018052973, D7 cited in the ESR, are not listed in this IDS since they were already listed in the IDS filed Jan. 21, 2022).

EP Office Action dated Oct. 26, 2023 in application EP 20740532.9, counterpart of co-pending U.S. Appl. No. 17/629,125 and of this application; with English machine translation (total 10 pages).

EP Search Report and Written Opinion dated Oct. 27, 2023 in divisional application No. EP 23195357.3, counterpart of co-pending U.S. Appl. No. 17/629,125 and of this application; with English machine translation (total 16 pages) (note: D1-D4 cited in the ESR dated Oct. 27, 2023 are also cited in the EP Office Action dated Oct. 26, 2023, D5-D8 cited in the ESR dated Oct. 27, 2023 are not listed in this IDS since they are already of record).

AR Office Action dated Oct. 18, 2023 in application AR 20200102053, counterpart of co-pending U.S. Appl. No. 17/629,125 and of this application; with English machine translation (total 38 pages) (note: EP0258299, FR2741048, WO8908062, EP0108550, D1, D2, D3 and D5 cited in the AR Office Action, are not listed in this IDS since they are already of record in this application).

Office Action dated Dec. 19, 2023 in co-pending U.S. Appl. No. 17/629,125; w/Appendix and PTO892 pp. 1-2, without returned SB08 (total 17 pages) (note: refs. I-M in PTO892 p. 1 and refs. A-C, F, H-K in PTO892 p. 2 of the Office Action are not listed in this IDS since they are already of record in this application; US20220289468, ref.L in PTO892 p. 1 is the publication of this Application).

Notice of Allowance dated Sep. 23, 2024 in co-pending U.S. Appl. No. 17/629,125; with PTO892 pp. 1 and 2, without AFCP Decision (total 10 pages) (note: US20030089739, US20220297925, U.S. Pat. No. 6,357,633, refs. A, D, H in the PTO892 p. 1, and U.S. Pat. No. 3,893,653, U.S. Pat. No. 2,775,483, refs. A, I in the PTO892 p. 2 of the Notice of Allowance are not listed in this IDS since they are already of record in this application).

Final Office Action dated Jul. 11, 2024 in co-pending U.S. Appl. No. 17/629, 125; with PTO892, without returned SB08 (total 12 pages) (note: U.S. Appl. No. 11/845,605, U.S. Pat. No. 9,694,967, U.S. Pat. No. 5,881,929, refs. B, D, E of the Office Action are not listed in this IDS since they are already of record in this application).

EP Office Action dated Oct. 2, 2024 in counterpart application EP 20743094.3; with English machine translation (total 12 pages) (note: US2016009482 and WO8101130, D1 and D4 cited in the EP Office Action, are not listed in this IDS since they are already of record in this application).

Notice of Allowance dated Jan. 22, 2025 in co-pending U.S. Appl. No. 17/629, 125; with PTO892, without returned SB08 (total 8 pages).

* cited by examiner

VALVE CUP FOR PRESSURIZED CONTAINER

FIELD OF THE INVENTION

The invention relates to a valve cup for pressurized container. The valve cup has an outer face and an inner face and is provided with

- a peripheral bearing edge for placing the cup on a can,
- a central opening for the passage of a product outlet rod,
- a descending wall in the continuation of the bearing edge, and
- a bottom wall between the descending wall and the central opening.

STATE OF THE ART

Valve cups according to the preamble are commonly used for pressurized containers, in particular for aerosol dispensers. A valve body is fixed to the cup, forming an internal chamber in which are located a spring, a seal, and between the two, at least a portion of the valve member. The spring pushes the valve member against the seal so that the valve is closed. To insert the seal, the spring and the valve member, it is necessary to have an opening for access before final assembly. Traditionally, the cup is provided with a dome, which is crimped on the top of the valve body, provided for this purpose with an annular extra thickness at its top. This method works very well when the cup is metallic. However, the current trend is to eliminate metal parts and replace them with polymer whenever possible, in order to facilitate recycling of aerosol dispensers. Valves are therefore known in which the cup too is made of polymer.

In this case, it is possible to have a single-piece unit constituted by the valve body and the cup, the internal space then being closed by a washer welded from above. Such a valve is known from document WO 2016/202754 A1, for example. The drawback of this solution lies in the fact that, if the weld between the washer and the cup were defective, the washer could come off and be forcefully expelled, at the risk of injuring its user.

In other variants, the valve body is fixed to the cup by snap-fastening. As an example, document FR 2 508 136 A1 can be cited. This requires more complex molds to make, on the one hand, the snap-fastening tabs on the cup or the valve body and, on the other hand, the corresponding recesses on the other part. In addition, the parts must be oversized to take into account the height of the fixation.

Objective of the Invention

The objective of the invention is to provide a cup that is economical to manufacture. Another objective is to design the cup that, when used for a male valve, protects at least partially the protruding portion of the stem of a male valve.

DISCLOSURE OF THE INVENTION

This objective is achieved by the valve cup of the invention, in which the bottom wall comprises at least one frustoconical peripheral portion the outer face of which is concave.

The cup is preferably configured to receive on its inner face a valve body. In other words, the inner face of the valve cup can be provided with means for fixing a valve body. These means can be in particular a material to which the valve body can be glued or welded.

The bottom wall can comprise a flat central portion located between the frustoconical peripheral portion and the central opening. Although this flat central portion can have advantages, in particular for fixing a valve body, it is however not required.

The edge of the bottom wall which surrounds the central opening can be in alignment with the frustoconical peripheral portion or, if the bottom wall comprises a flat central portion, in alignment with said flat central portion. In other words, the edge can be in the same frustoconical surface as the peripheral portion or in the same plane as the central portion. However, it can be useful to roll up the edge to prevent the edge surface of the cup at the central opening from being in contact with a remainder of product that would have fallen into the cup, for example. For this purpose, it can be provided that the edge of the bottom wall which surrounds the central opening is rolled up, forming a rolled edge, preferably rolled up on the side of the outer face of the cup. Thus, the edge surface of the edge of the cup surrounding the central opening is located at a distance from, and preferably above, the bottom wall.

The bearing edge of the cup can be provided with an annular cavity into which the neck of a can can penetrate. This solution will be preferred, for example, if an O-ring is placed between the cup and the neck of the can. Otherwise, the peripheral end of the bearing edge can be in the form of a flat ring and/or of a ring the wall of which is inclined towards the center of the cup. In other words, the bearing edge does not descend after reaching its highest point. The inclined wall can be frustoconical or partially toric, for example. Its inner face preferably has substantially the dimensions and the shape of the neck of the can for which it is intended.

At least the inner face of the cup can be made of polymer, preferably polypropylene or another polyolefin (PE, PET, TPE), which is virgin, recycled or biobased. This makes it possible, on the one hand, to serve as a seal if the cup is fixed to the can by expansion, and on the other hand, to weld a valve body to the inner face of the cup, as will be presented below.

At least the outer face of the cup can be metallic, preferably aluminum or tinplate. This allows the cup to be fixed by expansion. In addition, this metal layer gives the cup sufficient rigidity to withstand the pressure within the pressurized container. If necessary, reinforcing ribs can be provided on at least one face of the cup, preferably the outer face.

The invention also relates to a valve provided with a cup according to the invention. Such a valve is constituted by a cup of the invention, a valve body in which are placed a spring, a valve member, and a valve seal, the valve body being fixed to the inner face of the cup. According to the invention, the valve seal is pressed against the inner face of the bottom wall of the cup, surrounding the central opening, and the valve body is fixed to the inner face of the bottom wall by welding or by gluing. The valve body can be welded to the flat central portion of the bottom wall or to the frustoconical peripheral portion of the bottom wall.

When the valve is a male valve, the valve member is constituted by the nozzle and a protruding portion of the nozzle protrudes from the outer face of the cup through the central opening. In this case, at least the lower portion of the protruding portion of the nozzle, preferably at least half this protruding portion, is located in the cavity defined by the plane passing through the top of the bearing edge, the descending wall and the bottom wall.

In a preferred embodiment of the invention, at least before mounting the valve on a can to form a container, the entire protruding portion of the nozzle is located in the cavity. In this case, the cavity is preferably configured to be closed, after filling the pressurized container at the latest, by a removable protection, preferably a peelable film or a cap.

The valve body can comprise a tubular body provided with

- at one end, an annular tapered edge, which tapered edge bears sealingly against the valve seal while surrounding the central opening, as well as
- a fixing crown by which the valve body is welded to the cup.

The tubular body can comprise a cylindrical wall provided at its upper end with the tapered edge and continued at the other end by a wall that narrows along a direction opposite to the tapered edge.

BRIEF DESCRIPTION OF THE FIGURES

The invention is described in more detail below with the aid of the figures which show.

DETAILED DESCRIPTION OF THE INVENTION

Figure 1:
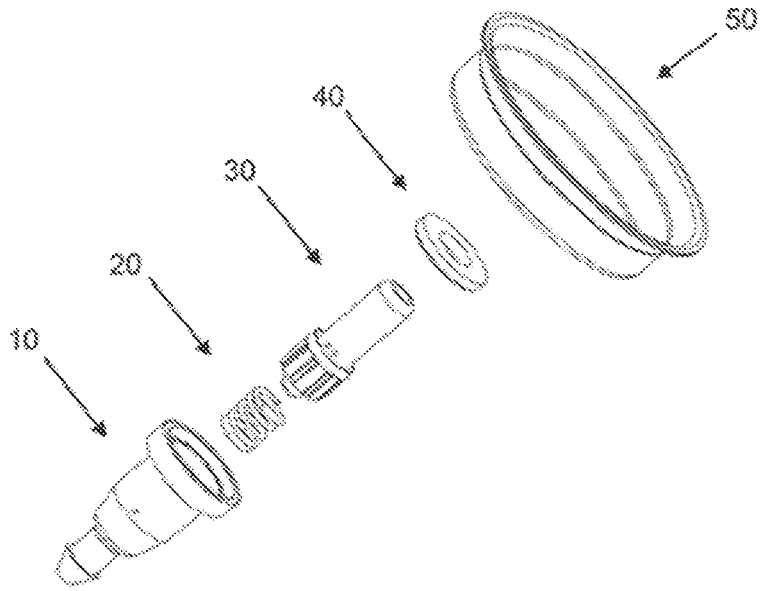
FIG. 1 an exploded view of a male type valve provided with a cup according to the invention.

The invention relates to a valve cup for a valve (1) intended for a pressurized container. The valve (1) is constituted mainly of:

- a cup (50), and
- a valve body (10) in which are placed:
  - a spring (20),
  - a valve member (30) and
  - a valve seal (40).

Valves having a valve member are sealed by a valve member that must be moved away from the valve seal to allow the product to exit the valve. The product leaves the valve through a small tube, called stem or rod, which passes through a central opening of the cup.

The valve (1) of the invention can be used in all positions. In the figures illustrating this application, the valve is shown with the stem or the opening for access to the female valve directed upwards. The references "top"/"bottom" or "upper"/"lower" have only a relative value in relation to the representations of the accompanying figures. It is self-evident that the valve can be used in all positions and that what is up in the position shown here will not necessarily be so during use. Further, the valve extends longitudinally with respect to a main axis (A), which is vertical in the representations of the accompanying figures. The terms "radial", "axial" and "transverse" refer to this main axis (A).

As with any valve with cup, the cup (50) forms a separation between the side of the valve intended to be placed inside the can and the other side intended to be outside the can. The terms "inner" and "outer" refer to the elements located on the inner side or on the outer side of the cup. The terms "internal" and "external" refer to a specific component (in particular the valve body) and define what is inside or outside said component, regardless of whether it is a component located on the inner or outer face of the cup.

Figure 2:
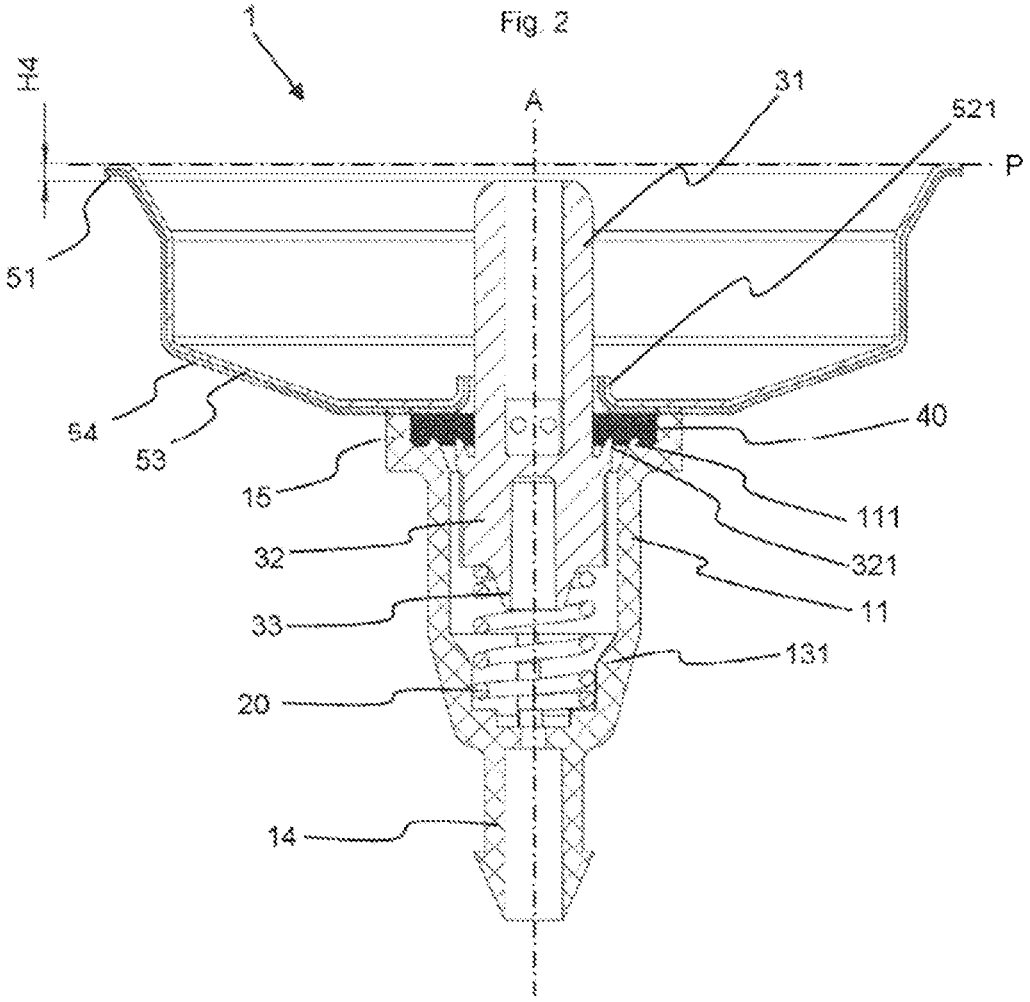
FIG. 2 a cross-sectional view of the valve of FIG. 1.
Figure 3A:
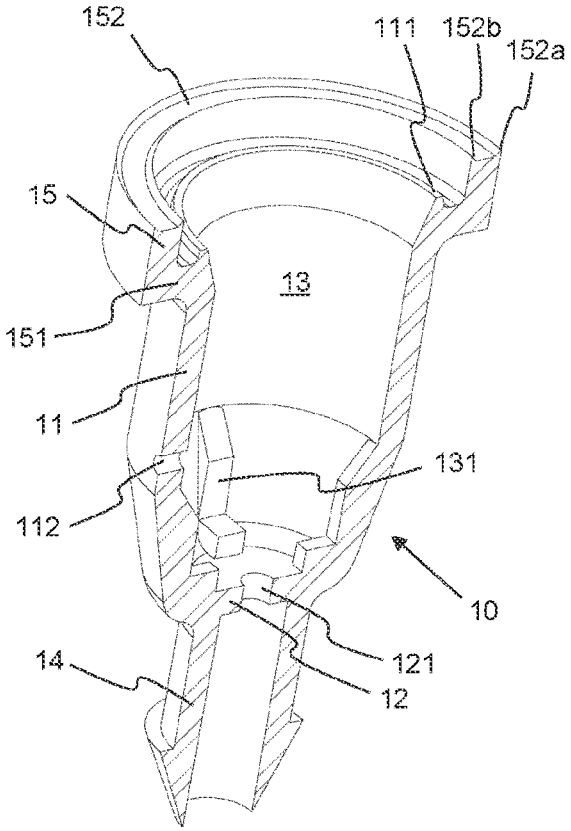
FIG. 3 a cross-sectional and perspective view (a) of the valve body of the valve of FIG. 1, and (b) of the male valve stem.
Figure 3B:
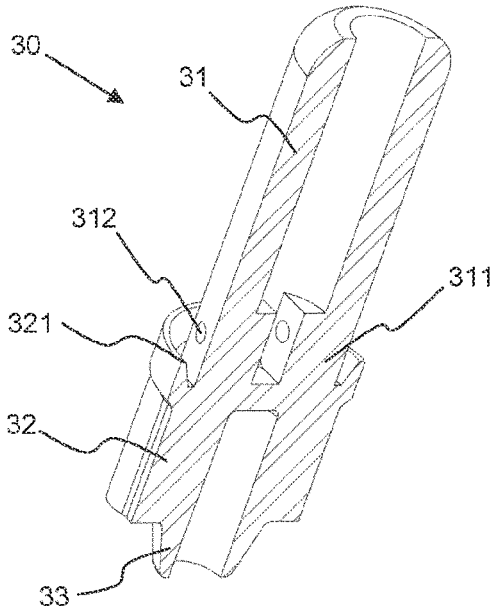
Figure 4:
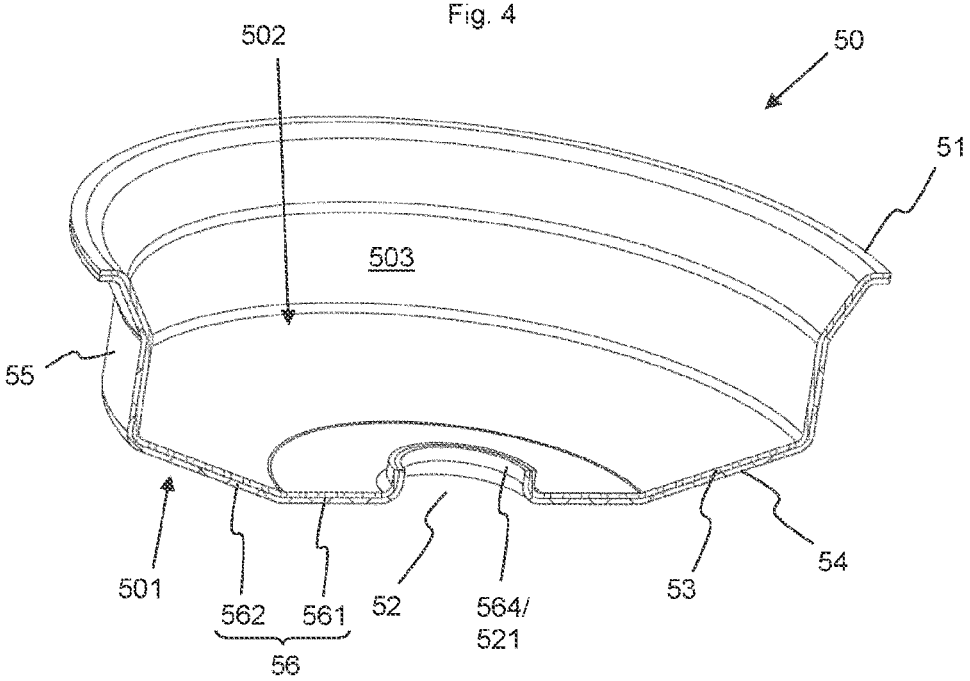
FIG. 4 a cross-sectional and perspective view of the valve cup of FIG. 1.
Figure 5:
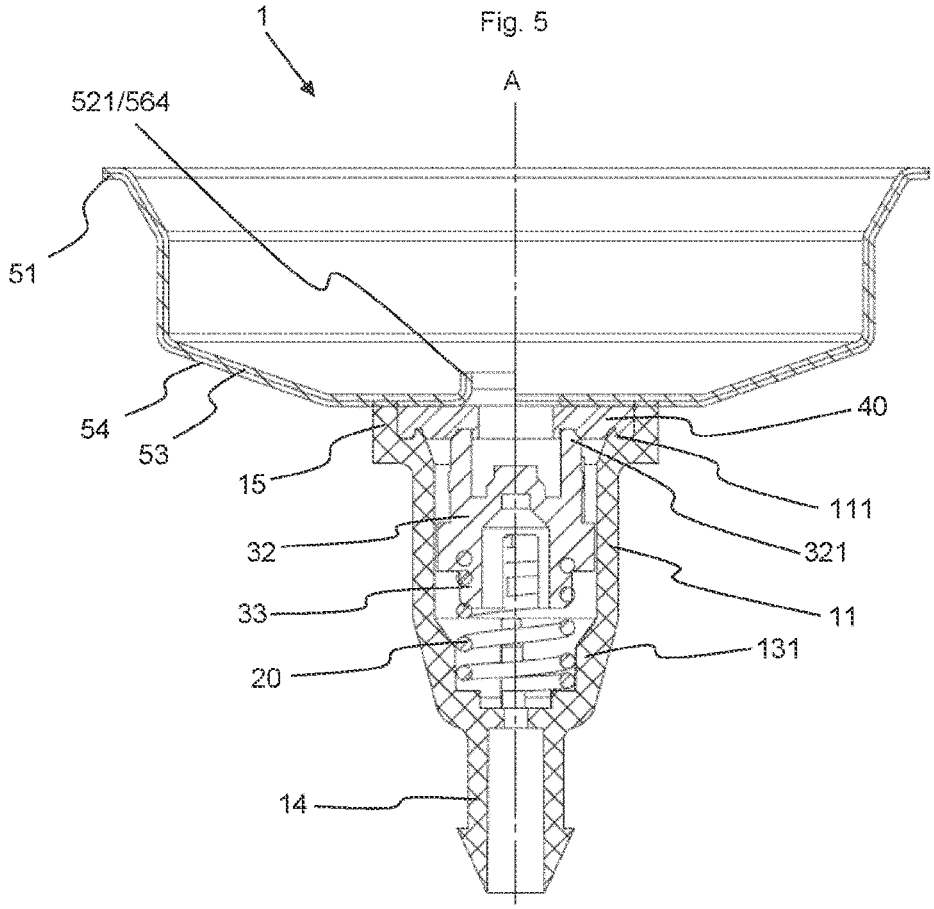
FIG. 5 a cross-sectional view of a female type valve provided with a cup according to the invention, showing (a) on the left, a cup with a rolled central edge and (b) on the right, a cup with a simple central edge.
Figure 6:
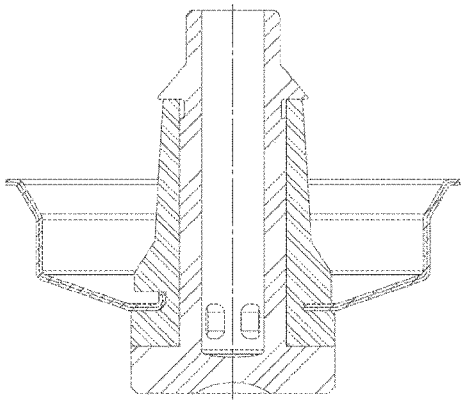
FIG. 6 a cross-sectional view of a high flow type valve provided with a cup according to the invention, showing (a) on the left, a cup with a rolled central edge and (b) on the right, a cup with a simple central edge.
Figure 7:
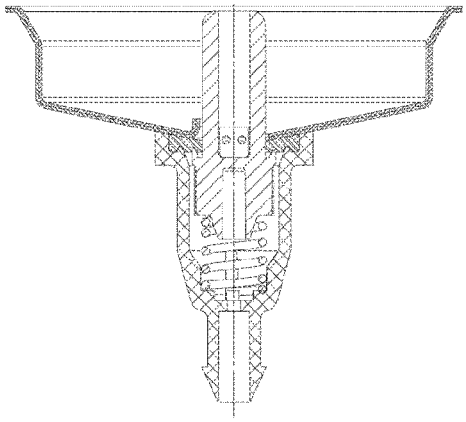
FIG. 7 a cross-sectional view of a male type valve provided with a cup according to the invention, the bottom of which is constituted exclusively by a frustoconical portion, showing (a) on the left, a cup with a rolled central edge and (b) on the right, a cup with a simple central edge.

The examples shown in FIGS. 2 and 7 are male type valves in which the valve member is an integral part of the stem (30), a portion of the rod (31) of which protrudes outside of the valve. As shown in FIG. 5, the invention can also be applied to a female type valve having as valve member a valve seat, which is located in the valve body and which must be actuated by an outer rod (generally, that of an actuator) which penetrates in the valve through the central opening. The invention can also be used for a high flow type valve such as the one illustrated in FIG. 6. To simplify the description, the term "stem" is used to designate a rod provided with a valve member, forming a male valve stem or male rod, while the term "rod" is used more generally to designate the small outlet tube that passes through the central opening of the cup, whether this rod is part of a male valve "stem" or of an actuator for female valve.

The valve body (10) is formed mainly by a tubular body (11) partially closed at a first end, called the lower end, by a bottom wall (12) having an inlet opening (121). The tubular body (11) and the bottom wall (12) together define an internal chamber (13). Vertical ribs (131) can be provided in the bottom of the internal chamber, near the bottom wall. These ribs protrude radially from the tubular body towards the center of the internal chamber, forming a receiving space in which a first end of the spring (20) can be received and retained radially. A fixing tenon (14) can be provided on the external face of the bottom wall (12) for fixing, for example, a dip tube or anti-collapsing means. This tenon (14) has a tubular shape and surrounds the inlet opening (121).

To save material, it is preferable that the wall of the tubular body (11) narrows in the portion carrying the vertical ribs (131). In particular, this portion can be frustoconical. Thus, the tubular body (11) and the internal chamber (13) are essentially formed by an upper cylindrical portion that is continued downwards by a narrowing portion (which is frustoconical here) closed at the bottom by the bottom wall (12). In valve bodies of the state of the art, the tubular wall and the internal chamber remain cylindrical until the bottom wall. This narrowed portion contributes to reducing the cost of manufacturing the valves of the invention.

At least one opening (112) can be provided in the tubular body (11), which opening forms a passage bringing the external face and the internal face of the tubular body in contact. This opening, which is not required, serves as an additional gas inlet to improve the quality of the spraying.

The second end of the tubular body (11) ends with a tapered edge (111). It is surrounded by a fixing crown (15) which is constituted by a tubular wall connected to the second end of the tubular body by a transverse wall (151). This transverse wall is, for example, parallel to a plane perpendicular to the main axis (A). It can be solid, as in the present example, or crenellated if it is not necessary to ensure sealing between the two faces of this transverse wall. The annular edge surface (upper face) (152) of the fixing crown (15) is preferably provided with at least one extra thickness of material that extends all around the crown and serves as energy director during ultrasonic welding of the valve body on the cup. In the example presented here, there are two rings of extra thickness of material (152*a*, 152*b*).

The cup (50) is constituted by a plate provided with

- a peripheral bearing edge (51) intended to place the cup on a can, not shown,
- a central opening (52) intended for the passage of a product outlet rod, and
- a wall that extends between the bearing edge (51) and the central opening, being divided into
  - a descending wall (55), and
  - a domed bottom wall (56).

The cup has a convex inner face (501) and a concave outer face (502). The descending wall (55) and the bottom wall (56) form a cavity (503) on the outer face (502) of the cup, which is limited by the plane passing through the top of the bearing edge (51), which top corresponds to the portion of the bearing edge furthest from the central opening (52), considered along the central axis (A).

The descending wall (55) can be substantially cylindrical as in the examples presented here, or slightly frustoconical. It serves, on the one hand, to move the central opening (52) away from the bearing edge (51), helping to make the cavity (503) deeper, and on the other hand, in certain cases, to fix the cup to the neck of the can, especially when the cup is mounted by expansion.

Figure 11:
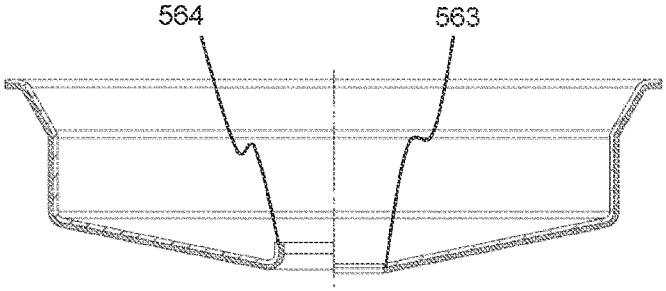
FIG. 11 a cross-sectional view of a fourth cup with a short peripheral edge and the bottom of which is constituted exclusively by a frustoconical portion, showing (a) on the left, a cup with a rolled central edge and (b) on the right, a cup with a simple central edge.
Figure 12:
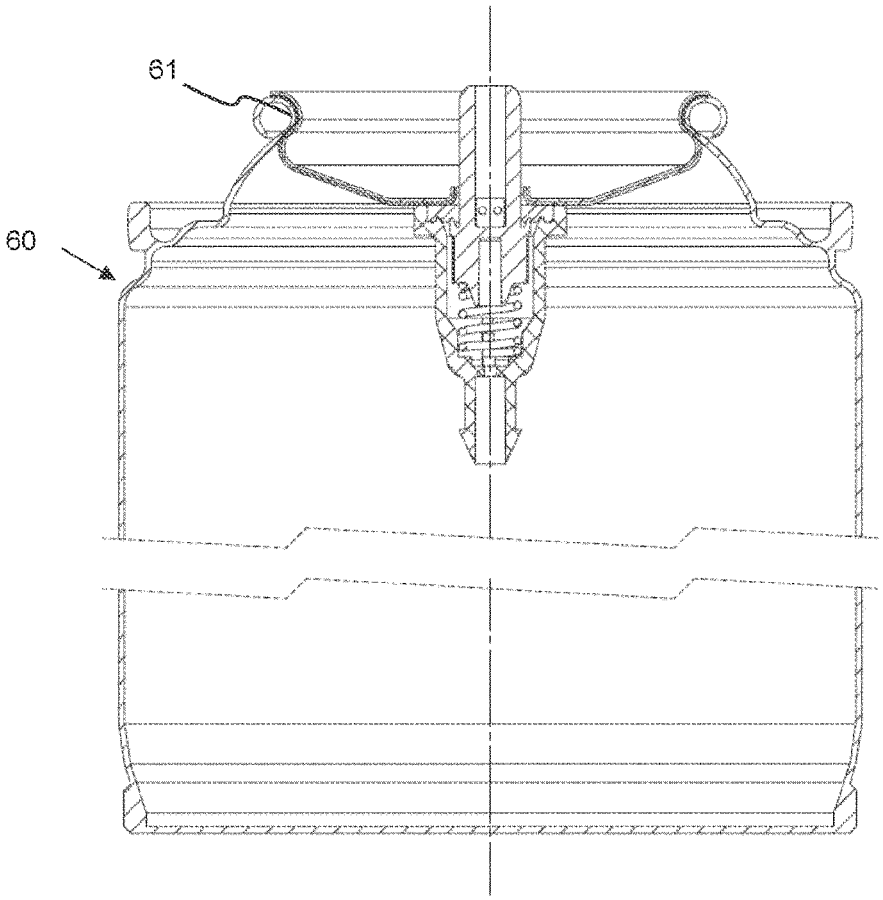
FIG. 12 a cross-sectional view of the valve of FIG. 1 mounted by expansion on a can, thus forming a pressurized container.

With the exception of the cup of FIGS. 7 and 11, the domed bottom wall (56) is divided into a flat central portion (561) surrounding the central opening (52) and an inclined peripheral portion (562) located between the flat central portion (561) and the descending wall (55). The peripheral portion (562) is preferably frustoconical. As shown in FIGS. 7 and 11, the cup can also have an entirely frustoconical bottom. The inclination of the frustoconical portion is such that the inner face of the bottom wall is convex and/or that the outer face of the bottom wall is concave.

The inclination of the frustoconical portion (562), on the one hand, serves to position the central opening (52) away from the bearing edge (51), and on the other hand, allows the cup to resist the pressure within the pressurized container.

The bearing edge (51) serves to place the cup on the neck (61) of the can (60). The outer diameter of the bearing edge must be greater than the diameter of the neck so that the cup does not fall into the can. In the case of cups mounted by expansion, the neck of the can is generally rolled and the bearing edge surrounds at least the internal portion of the neck. It can be preferable that the bearing edge surrounds the neck on both sides of its top. In this case, the bearing edge (51) forms an enveloping annular cavity (511) into which the neck of the can can penetrate. Such is the case with the cup of FIG. 9. When the cup is mounted by expansion, the bearing edge (51) substantially matches the shape of the neck and envelops it beyond the top of the neck.

Figure 9:
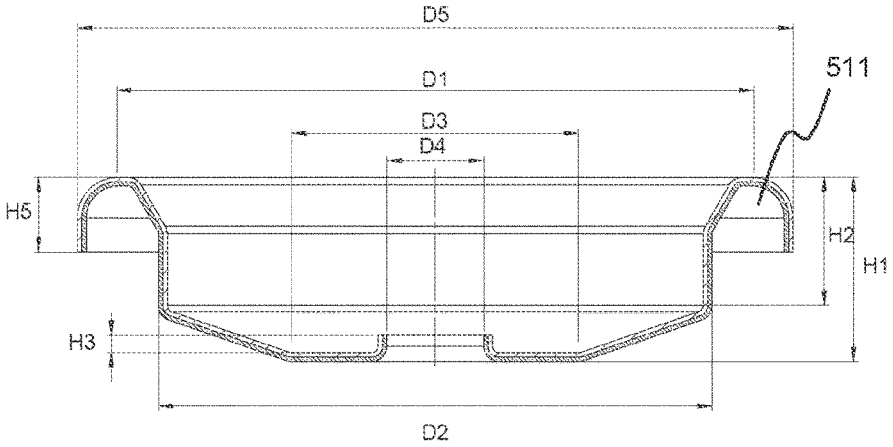
FIG. 9 a cross-sectional view of a second cup with a rolled central edge and an enveloping peripheral edge.

When a specific seal is provided between the cup and the neck of the can, the seal is preferably placed in the annular cavity (511) of the cup of FIG. 9. It is then necessary to compress the seal during expansion. In such a case, it is common to exert a force which may be of the order of 75 kg on the cup during expansion.

In order to save material, however, it is possible to dispense with this enveloping end and with the annular cavity (511). It is sufficient if the bearing edge (51) is wide enough to retain the cup on the neck of the can when fixing the cup to the can.

The inner face (501) of the cup can be provided with a layer (54) that can serve as a seal. For example, this layer can be made of polymer, preferably of polypropylene or another polyolefin (PE, PET, TPE), which is virgin, recycled or biobased, of food grade or not. In such a case, it is not necessary to exert such a large force on the cup during mounting by expansion, because the sealing is obtained essentially at the interface between the descending wall (55) and the inside of the neck in the location of the expansion. The force exerted is a substantially radial force that does not subject the bearing edge to as high a stress as for cups having a seal in the annular cavity. The force exerted on the cup during attachment serves mainly to hold it in place and does not need to be very great. It is therefore possible to dispense with the annular cavity (511), the bearing edge simply having to be sufficient to retain the cup despite the pressure exerted to hold the cup in place. This measure makes it possible to save the material necessary to form the annular cavity.

In a simple embodiment of the cup, the edge (563) of the bottom wall (56) surrounding the central opening (52) is in alignment with this bottom wall, that is, it is in the plane of the flat central portion (561), or in the same frustoconical envelope as the frustoconical peripheral portion (562) if there is no flat central portion. Such is the case with the cups shown on the right in FIGS. 5, 6, 7 and 11, or with the cup of FIG. 10. However, this solution has the drawback that a remainder of product that would have fallen into the cup could be in contact with the sharp edge of the edge of the cup at the central opening, creating a risk that this edge could corrode if the cup is at least partially metallic. It may therefore be preferable in certain cases to roll up the edge (564) of the central portion (561), forming a rolled edge (521). This rolled edge is preferably folded upright towards the outer face of the cup as shown on the left in FIGS. 5, 6, 7 and 11, or on the cup of FIGS. 2, 4, 8 and 9. Regarding FIGS. 5 to 7 and 11, it should be understood that they each represent two types of cups, and that a cup has either a simple edge (as shown on the right of the figures) or a rolled-up edge (as shown on the left of the figures).

The valve cup is therefore preferably configured so that the valve body is fixed on a convex or planar portion of its inner face, but not in a concave portion as in the state of the art. The central opening (52) on the outer face (502) of the cup is sufficiently low in the cavity and away from the plane defined by the top of the bearing edge to allow the protruding portion of the stem (31) to be at least partially located in said cavity (503). The inlet of the central opening (52) on the inner face of the cup is located at the lowest level of the cup, and at the level furthest from the plane formed by the top of the bearing edge. In other words, the product outlet rod leaves the valve body (10) and enters this central opening (52) at the lowest level of the inner face of the cup. Expressed still differently, the interface between the central opening (52) and the internal chamber (13) of the valve body is located at the lowest level of the inner face of the cup. This does not necessarily imply that the valve body is also fixed at the lowest level of the cup. Indeed, if the fixing crown (15) is not fixed to the flat central portion (561), but to the frustoconical peripheral portion, the interface between the cup and the valve body is located at a level higher than the interface between the central opening (52) and the internal chamber (53).

Generally, the rod that passes through the central opening (52) can carry the valve member to be inserted into the valve body if the valve is a male type valve (male valve stem), or it can be carried by an actuator intended to actuate the valve if the valve is a female type valve.

The cup can be made entirely of polymer. It is also possible that it is constituted, as in the present example, by a metallic outer layer (53) and an inner layer (54) in polymer. It is possible to choose a laminate of metal and polymer, for example. In particular, a laminate of 0.25 mm of steel and 200 μm of PP is especially well suited to the invention.

When the cup is constituted at least partially by metal, it is possible to mount it on the neck of the can by expansion. In this case, the descending wall (55) is deformed towards the outside of the cavity of the cup. This operation can cause a slight deformation of the cup and a rise of the central opening (52) and consequently of the stem (30) or of the seat of the valve. This slight rise can be taken into account when choosing the stem or actuator to be used to open the valve.

It is also possible that the cup is glued or welded to the can. In this case, the fixation can be at the bearing edge and/or at the descending wall.

Figure 8:
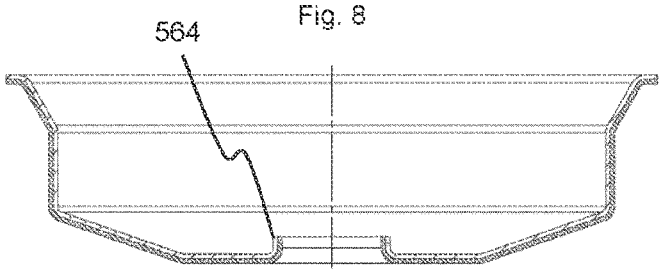
FIG. 8 a cross-sectional view of a first cup with a rolled central edge and a short peripheral edge.
Figure 10:
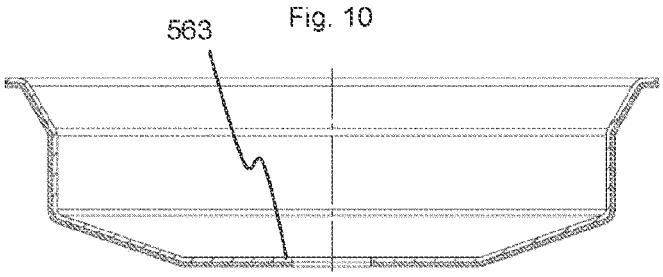
FIG. 10 a cross-sectional view of a third cup with a simple central edge and a short peripheral edge.

The cup can be defined by its dimensions, notably the following dimensions:

D1 External diameter of the cup, measured either at the point where the bearing edge descends to form an annular cavity (511) as in FIG. 9, or at the flat or inclined peripheral end when the bearing edge does not have a cavity for the neck of the can, as in FIGS. 8 and 10 for example;

D2 Diameter of the descending wall, measured in its widest portion;

D3 Diameter of the junction between the frustoconical peripheral portion (562) and the flat central portion (561) of the bottom wall;

D4 Internal diameter of the central opening (52);

D5 Diameter of the outer edge of the annular cavity (511);

H1 Total height of the cup defined as being the distance between the projection on the central axis (A) of the top of the outer face of the bearing edge (51) and the projection on the central axis (A) of the inner face of the cup at the central opening (52);

H2 Distance between the projection on the central axis (A) of the top of the outer face of the bearing edge (51) and the projection on the central axis (A) of the bottom of the descending wall (55);

H3 Distance between the projection on the central axis (A) of the top of the rolled edge (521/564) and the projection on the central axis (A) of the inner face of the cup at the central opening (52);

H4 Contact height before mounting the cup on the can, defined as being the distance between the projection on the central axis (A) of the top of the stem (31) and the projection on the central axis (A) of the top of the outer face of the bearing edge (51);

H5 Depth of the annular cavity receiving the edge of the can.

Knowing H1 and H2 on the one hand and D2 and D3 (or D4 when there is no flat central portion (561)) on the other hand, the angle of inclination of the frustoconical peripheral portion (561) of the bottom wall can be determined.

The table below shows examples of dimensions.

Examples of dimensions expressed in mm

| Dimensions | Examples of ranges | Valve FIG. 2 | Valve FIG. 6 | Valve FIG. 7 | Cup FIG. 9 |
|---|---|---|---|---|---|
| D1 | 25.50-35.00 | 28.95 | 30.00 | 31.00 | 28.00 |
| D2 | 23.00-25.30 | 25.15 | 24.00 | 24.50 | 25.00 |
| D3 | 2.50-24.50 | 13.00 | 11.00 | | 14.00 |
| D4 | 2.50-9.00 | 4.40 | 8.6 | 4.40 | 3.10 |
| D5 | 32.00-33.00 | | | | 32.50 |
| H1 | 6.00-12.00 | 8.40 | 11.00 | 8.60 | 9.30 |
| H2 | 5.00-6.00 | 5.84 | 5.96 | 6.00 | 5.20 |
| H3 | 0.00-1.50 | 0.80 | 0/1.00 | 0/1.00 | 1.30 |
| H4 | −15.00-20.00 | −0.40 | 11.00 | −0.20 | |
| H5 | 2.00-5.00 | | | | 3.40 |

The stem (30) has a usual shape. It is formed by a cylindrical wall (31) open at its upper end (311) and closed at its lower end, forming an outlet channel for the product. One or more orifices (312) placed at the bottom of the outlet channel pass radially through the cylindrical wall to bring the internal face and the external face of said cylindrical wall (31) in contact. The cylindrical wall (31) constitutes the product outlet rod. This cylindrical wall is continued by the portion serving as valve member, which comprises a crown (32) of larger diameter having on its external face vertical channels or vertical ribs allowing the product to bypass the crown. The outer envelope of this crown has a diameter slightly smaller than the internal diameter of the tubular body (11) of the valve body so that it can enter into the latter while being guided. On its upper annular face, the crown (32) is provided with a sealing rib (321) to ensure sealing with the valve seal (40). The crown (32) is continued downwards by a guiding tenon (33) intended to cooperate with the second end of the spring (20). The seat of female valves and the grommet of high flow valves also have common shapes.

The valve seal (40) is also a classic part. It is an annular seal, the internal diameter of which is chosen to fit tightly and sealingly around the cylindrical wall (31) of the stem or of the rod of an actuator. The external diameter is chosen so that the entire tapered edge (111) of the tubular body of the valve body can bear sealingly against the valve seal (40). In the present example, the valve seal takes place in the space delimited, on the one hand, by the internal face of the fixing crown and, on the other hand, by the transverse wall (151).

The spring is caught between the bottom wall (12) of the valve body and the guiding tenon (33) of the stem or of the seat.

The male valve of the invention is assembled as follows. The spring (20) is placed in the bottom of the internal chamber (13) with its first end located between the vertical ribs (131). The valve seal (40) is mounted on the stem (30) so that, on the one hand, it obstructs the orifices (312) of the stem, and on the other hand, it bears sealingly against the sealing rib (321). The stem/seal assembly is inserted into the valve body by the guiding tenon (33) so that the latter (33) penetrates into the second end of the spring (20). The cup is then put in place by passing the free end of the stem through the central opening (52). The cup is brought closer to the valve body until the annular edge surface (152) contacts the inner face (54) of the cup. In this position, the valve seal (40) bears sealingly against the tapered edge (111). All that remains is to weld the cup and the valve body to each other at the annular edge surface (152). This weld can be made by any suitable means, and in particular by ultrasonic welding or by spin welding.

In the example presented here, the cup is substantially planar at the location of the the valve body and around the valve body. The height of the internal face of the fixing crown is substantially identical to the thickness of the valve seal (40). The tapered edge (111) helps to press the seal in a sealed manner against the inner face of the cup. Sealing between the cup (50) and the valve body (10) is therefore ensured by the valve seal being squeezed against the inner face (54) of the cup by the tapered edge (111), forming an annular seal all around the central opening (52). The weld at the interface between the fixing crown and the cup therefore does not need to be sealed. It must only hold the valve body against the cup against the effect of the spring (20) and ensure the valve seal (40) is properly pressed against the inner face (54) of the cup. It therefore would be possible for the weld to not be continuous.

It would also be possible for the cup to not be flat, and in particular, for the central opening (52) to be located in the center of the frustoconical peripheral portion (562) of the bottom wall.

It is possible to provide for reinforcing the cup so that it better withstands the pressure within the pressurized container. In the present example, insofar the outer layer (53) is metallic, the concave shape of the outer face (53) of the cup and the convex shape of the inner face (54) can be sufficient to obtain a sufficiently rigid cup. However, such a measure may prove to be insufficient in certain cases, in particular when the cup is made exclusively of polymer. Vertical and radial reinforcing ribs can then be provided on at least one of the faces of the cup, in particular on the outer face (53).

The valve body and the cup must be compatible if the valve body is to be welded to the cup. Polypropylene, or other polyolefins, can be chosen, for example, for the valve body and the cup or the polymer layer of the cup. The valve body and the cup are not necessarily made in the same polymer.

The advantage of the valve according to the invention lies in the fact that no part can be ejected from the valve. Indeed, all the parts are located on the side of the inner face of the cup and none is dimensioned to pass through the central opening. The weld between the valve body and the cup is not subjected to any tensile force. It therefore does not need to be particularly resistant.

In addition, by fixing the valve body to the inner face of the convex cup, it is no longer necessary to provide, as in the state of the art, a fixing dome intended to crimp the cup on the fixing crown (15) of the valve body. This has two major advantages. On the one hand, it saves the material required for stamping the dome. For a cup of the same diameter, a smaller sheet metal piece can be used than for a cup with a fixing dome. On the other hand, in the case of male valves, the portion of the stem that protrudes outside the valve and on which the actuator must be fixed is located at least partially inside the cavity formed by the cup, as clearly visible on FIGS. 2 and 7. Even if the cup is deformed during mounting by expansion on the can and/or during pressurization, and the central opening is thereby slightly raised, the protruding portion of the stem remains at least largely sheltered, recessed inside the cavity formed by the cup. The cup can be configured to allow fixing a removable protection on its upper face to close the cavity after filling the pressurized container. In particular, one can provide a peelable film fixed to the top of the bearing edge or a cap fitted over the bearing edge or inside the cavity (503). If filling is not done via the valve and fixing the cup to the can does not require access to the cavity (503), the cavity (503) can be closed by the removable protection even before assembly with the valve body.

The inclination of the frustoconical portion (562) will be chosen as a function of the pressure within the pressurized container and of the distance that must separate the central opening (52) and the bearing edge (51), in other words, the depth of the cavity of the cup. At the same time, the height of the stem (30) of a male valve will be chosen as a function of the depth of the cavity and of the contact height (H4) desired by the customer. The stem must protrude from the cup by a sufficient height corresponding at least to the sum of the opening stroke of the stem and the height necessary for fixing the actuator. For a same cup, stems of different sizes can be used to adapt the contact height (H4) to the specific needs of the customer. Likewise, for a same stem, the inclination of the frustoconical portion (562) of the bottom wall and the height of the descending wall (55) can be adapted.

The person skilled in the art understands that the fact that the stem is at least partially recessed in the cavity (503) of the cup can be obtained without the bottom wall necessarily having a frustoconical portion (562). Thus, the invention relates more generally to a male valve cup having an inner face and an outer face, and provided with

- a central opening for the passage of the protruding portion of the stem,
- a cavity on the outer face, said cavity surrounding the central opening,
- the cup being configured to receive a valve body on its inner face, preferably in a flat or convex portion of its inner face, and
- the edge of the cup surrounding the central opening being positioned so that at least a portion of the section of a stem protruding out of the cup on the outer side is located in the cavity. The valve cup is therefore configured so that the valve body is fixed to a convex or planar portion of its inner face, but not in a concave portion as in the state of the art. The inlet of the central opening (52) on the inner face of the cup is at the lowest level of the cup, and at the level furthest from the plane formed by the top of the bearing edge. In other words, the stem comes out of the valve body and penetrates into this central opening at the lowest level of the inner face of the cup. Expressed yet another way, the interface between the central opening and the internal chamber of the valve body is located at the lowest level of the inner face of the cup. This does not necessarily imply that the valve body is also fixed at the lowest level of the cup.

Likewise, those skilled in the art understand that fixing the valve body on the inner face of the cup also does not require the presence of a frustoconical portion on the bottom wall. The valve body could be fixed on the inner face of cups having a completely different geometries.

LIST OF REFERENCES

Valve according to the invention
Valve body
11 Tubular body
111 Tapered edge
112 Passage opening
12 Bottom wall
121 Inlet opening
13 Internal chamber
131 Vertical ribs
14 Tenon
15 Fixing crown
151 Transverse wall
152 Annular section of the fixing crown
152*a* Extra thickness for welding
152*b* Extra thickness for welding
20 Spring
30 Stem
31 Cylindrical wall
311 Lower end
312 Orifices
32 Crown
321 Sealing rib
33 Spring guiding tenon
40 Valve seal
50 Cup
501 Inner face of the cup
502 Outer face of the cup
503 Cavity in the outer face of the cup
51 Peripheral bearing edge
511 Annular cavity for surrounding the neck of the can
52 Central opening
521 Rolled edge
53 Metallic outer layer
54 Inner layer in polymer
55 Descending wall
56 Bottom wall
561 Flat central portion around the central opening
562 Frustoconical peripheral portion
563 Central edge in alignment
564 Rolled central edge
A Main axis
D1 External diameter of the bearing edge
D2 Maximum diameter of the descending wall
D3 Diameter of the junction between the frustoconical peripheral portion (562) and the flat central portion (561)
D4 Diameter of the central opening
D5 Diameter of the outer edge of the annular cavity
H1 Total height of the cup
H2 Distance between the top of the bearing edge and the bottom of the descending wall
H3 Distance between the top of the rolled edge of the bottom wall and the inner face of the cup at the central opening
H4 Contact height
H5 Depth of the annular cavity receiving the edge of the can

The invention claimed is:

1. A valve for pressurized container, the valve comprising a valve cup and a valve body, wherein the cup has an outer face and an inner face opposed to the outer face, wherein the cup is provided with:

a peripheral bearing edge for placing the cup on a can, a central opening for passage of a product outlet rod, a descending wall in a continuation of the peripheral bearing edge, and a bottom wall between the descending wall and the central opening, wherein the bottom wall of the cup comprises an inclined peripheral portion, wherein the inclined peripheral portion forms an obtuse angle with the descending wall, wherein an inlet of the central opening on the inner face of the cup is located at a lowest level of the cup and at a level furthest from a plane formed by a top of the peripheral bearing edge, and wherein the valve body is fixed to the cup, wherein a fixation between the valve body and the cup is only to an inner face of the inclined peripheral portion at an upper face of the valve body bearing against the inner face of the bottom wall of the cup, wherein the upper face of the valve body comprises:

a fixing crown fixed to the inner face of the bottom wall of the cup, and an annular protrusion surrounded by the fixing crown and forming an annular tapered edge, wherein the annular tapered edge bears sealingly against a valve seal and presses the valve seal against the inner face of the cup.

2. The valve according to claim 1, wherein the inclined peripheral portion is frustoconical.

3. The valve according to claim 1, wherein the bottom wall comprises a flat central portion located between the inclined peripheral portion and the central opening.

4. The valve according to claim 1, wherein an edge of the bottom wall which surrounds the central opening is in alignment with the inclined peripheral portion.

5. The valve according to claim 1, wherein an edge of the bottom wall which surrounds the central opening is rolled up, forming a rolled edge.

6. The valve according to claim 1, wherein the peripheral bearing edge of the cup forms an annular cavity into which the neck of a can penetrate.

7. The valve according to claim 1, wherein a peripheral end of the peripheral bearing edge has a shape of a flat ring or a ring having a wall inclined towards a center of the cup.

8. The valve according to claim 1, wherein at least the inner face of the cup is made of polymer.

9. The valve according to claim 1, wherein at least the outer face of the cup is metallic.

10. The valve according to claim 1, wherein reinforcing ribs are provided on at least one face of the cup.

11. The valve according to claim 1, wherein a spring and a valve member are placed in the valve body, the valve seal being pressed against the inner face of the cup on the bottom wall by the valve member under a force exerted by the spring, and wherein the valve body is fixed to the inner face of the bottom wall by welding.

12. The valve according to claim 11, wherein the valve member is formed by a stem of a male valve, a protruding portion of the stem protruding from the outer face of the cup by passing through the central opening of the cup, at least a lower portion of the protruding portion of the stem being located in a cavity of the cup defined by (i) a plane passing through a top of the peripheral bearing edge, (ii) the descending wall and (iii) the bottom wall of the cup.

13. The valve according to claim 12, wherein, at least before mounting the valve on a can to form a container, the entire protruding portion of the stem is located in the cavity.

14. The valve according to claim 11, wherein the valve body comprises a tubular body.

15. The valve according to claim 14, wherein the tubular body comprises a cylindrical wall provided at an upper end thereof with the annular tapered edge and continued at another end thereof by a wall that narrows along a direction opposite to the annular tapered edge.

16. The valve according to claim 11, wherein the welding between the valve body and the inner face of the bottom wall is discontinuous.

17. The valve according to claim 1, wherein the bottom wall comprises a flat central portion, and an edge of the bottom wall which surrounds the central opening is in alignment with the flat central portion.

18. The valve according to claim 1, wherein the inner face of the cup is made of polymer and the outer face of the cup is metallic.

19. The valve according to claim 1, wherein the valve body is fixed to the inner face of the bottom wall of the cup by welding or gluing.

20. The valve according to claim 19, wherein an annular upper edge surface of the fixing crown is provided with at least one extra thickness of material that extends all around the crown and is adapted to serve as energy director during ultrasonic welding of the valve body on the cup.

* * * * *